United States Patent [19]

Gwaltney et al.

[11] 4,060,121

[45] Nov. 29, 1977

[54] SPRUE REMOVAL MECHANISM FOR DIE CASTING APPARATUS

[75] Inventors: Robert E. Gwaltney, Brentwood; John L. Mikovits, Nashville, both of Tenn.

[73] Assignee: Bada Company, Inc., Elk Grove Village, Ill.

[21] Appl. No.: 702,933

[22] Filed: July 6, 1976

[51] Int. Cl.[2] ..... B22D 31/00

[52] U.S. Cl. ..... 164/262; 164/70

[58] Field of Search ..... 164/265, 262, 70

[56] References Cited

U.S. PATENT DOCUMENTS

| | | | |
|---|---|---|---|
| 937,477 | 10/1909 | Shonberg | 164/265 |
| 2,821,756 | 2/1958 | Pouell | 164/264 |
| 2,946,102 | 7/1960 | Mills | 164/265 |
| 2,995,788 | 8/1961 | Sunday | 164/70 |
| 3,191,246 | 6/1965 | Pouell | 164/262 X |
| 3,256,572 | 6/1966 | Fisher | 164/265 |
| 3,672,437 | 6/1972 | Bennett | 164/265 |
| 3,844,337 | 10/1974 | Scott et al. | 164/70 X |

*Primary Examiner*—Ronald J. Shore

*Attorney, Agent, or Firm*—Wegner, Stellman, McCord, Wiles & Wood

[57] ABSTRACT

In a die casting apparatus having a first die and a second die movable into closed engagement with the first die to define a mold cavity therebetween, a sprue removal mechanism includes a degater knife, a rocker arm mounted to pivot about a fixed axis and connected to the degater knife, a cam fixed to the second die, and a cam follower carried by the rocker arm. As the second die moves away from the first die, the cam follower travels along the cam to wing the rocker arm and drive the degater knife to an extended position between the open dies, thereby severing the sprue from a completed casting while the casting is supported by the first die.

9 Claims, 3 Drawing Figures

SPRUE REMOVAL MECHANISM FOR DIE CASTING APPARATUS

BACKGROUND OF THE INVENTION

This invention relates generally to die casting apparatus and, more particularly, to a mechanism employed in conjunction with a die casting apparatus for mechanically removing the sprue from a completed casting.

Cast articles are formed by injecting molten casting material into a mold cavity defined by interfitting dies. When producing cast articles by such a process, the casting generally has a sprue or gate of excess material formed thereon at the point where the molten material is injected into the mold cavity. Since the sprue is not an intended element of the completed casting, it must be removed.

Removal of the sprue can be achieved by removing the casting from the dies and subsequently trimming off the sprue manually or by separate operation at another machine. In the prior art, there are a number of die casting machines incorporating mechanisms which will remove the sprue at the dies while the dies are opening.

A number of machines employ hydraulically or pneumatically operated degater knives for shearing the sprue. Illustrative of these machines are Boberg U.S. Pat. No. 3,916,986, Halko et al U.S. Pat. No. 3,845,531, Scott et al U.S. Pat. No. 3,844,335, Fisher U.S. Pat. No. 3,256,572, Pouell U.S. Pat. No. 3,191,246, Mills U.S. Pat. No. 2,946,102 and McGarigal U.S. Pat. No. 2,612,666.

Other patents disclose the shearing of sprues by the dies themselves as the dies are moved apart to release the casting. These include Sunday U.S. Pat. No. 2,995,788 and Pouell U.S. Pat. No. 2,821,756.

SUMMARY OF THE INVENTION

It is the principal object of the invention to provide a sprue removal mechanism which can be employed in conjunction with a die casting apparatus and operated therewith so that a casting is formed and its sprue removed at a single machine station.

In accordance with the invention, a sprue removal mechanism utilized with a die casting apparatus having a movable die and a mating die includes a degater knife reciprocably mounted in a fixed housing, a rocker arm pivotally mounted and having one end connected to the degater knife and its other end to the movable die so that movement of the movable die away from the mating die operates to pivot the rocker arm, thereby reciprocating the degater knife and severing the sprue from the casting.

Cam means in the form of a slot or surface is fixed to the movable die to move therewith. The rocker arm has a cam follower or roller which engages and travels along the cam slot so that as the movable die is moved away from the other die to expose the casting and attached sprue, the degater knife is operated in suitable timed relationship to sever the sprue from the casting before the casting is released completely from the mold cavity.

By constructing the cam slot oblique to the direction of die movement and giving the slot a nonlinear shape, the degater knife can be driven so that it is moved from a fully retracted position to an extended position severing the sprue and then to a partially retracted position while the movable die is traveling in one direction away from the other die. The partial retraction of the degater knife permits the severed casting to fall free of the mold cavity and the dies before the dies are moved together again in preparation for another machine cycle.

The sprue removal mechanism may easily be incorporated into an existing die casting machine since the components can be mounted externally of the die casting machine without substantial modification thereto. The sprue removal mechanism advantageously employs the power of the opening dies for operation. Because the sprue removal apparatus is a mechanical device, it is substantially trouble-free, and responds only to die operation.

DESCRIPTION OF THE PREFERRED EMBODIMENT

Figure 1:
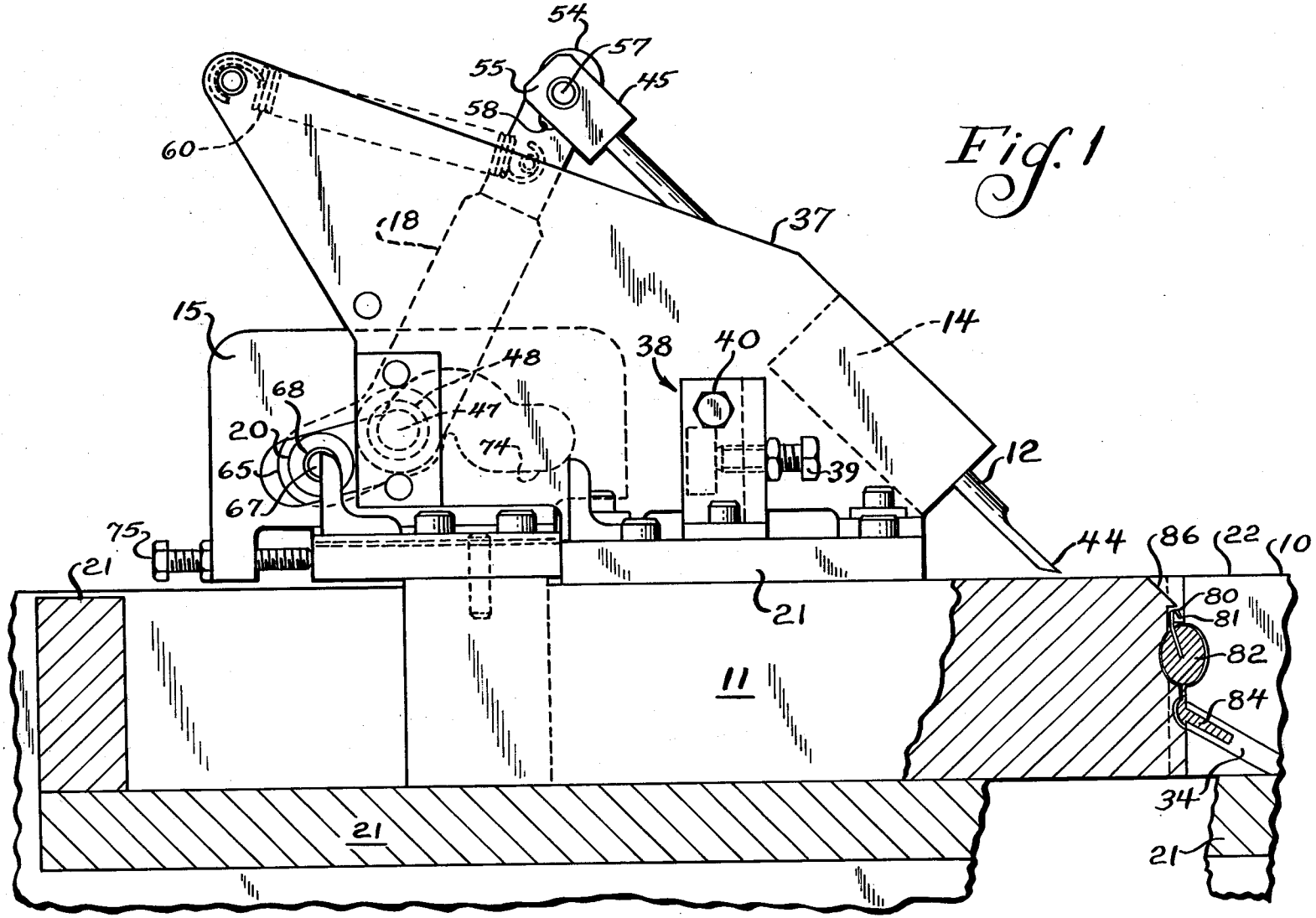
FIG. 1 is a side elevational view of the die casting and sprue removal mechanism shown partially in section and illustrating the dies in a closed forward position and the degater knife in a fully retracted position.

A die casting apparatus having a mechanism for mechanically removing sprues from castings constructed according to the invention includes a back die having two separable die segments, one of which is designated 10, a reciprocating front die 11 movable into engagement with the back dies 10, a degater knife 12 reciprocable within a stationary sleeve 14, an upright cam plate 15 fixed to the reciprocating front die 11 for movement therewith and having a nonlinear cam slot 17 formed therein, and a rocker arm 18 having a cam roller 20 engaging the cam slot 17 and being connected to the degater knife 12 so that relative movement between the cam slot 17 and the cam roller 20 actuates the rocker arm 18 to reciprocate the degater knife 12.

The front die 11 is reciprocable within a stationary supporting frame 21 and moves generally along an axis extending longitudinally toward the back dies 10. The back dies 10 are also carried by the frame 21. The back dies 10 are movable outwardly away from one another in a direction transverse to the axis of movement of the front die 11 and inwardly toward one another so that their respective mating edge faces 22 may be engaged. Movement of the dies 10 and 11 is mechanically interlocked so that they are opened or closed simultaneously at a suitable rate, as is well known.

Respective opposing die faces 24 and 25 in the front and back dies have respective recesses 27 and 28 which define a mold cavity 30 and an injection gate 31. An injector nozzle 34 through which molten casting material is delivered under pressure to the mold cavity 30 which is otherwise completely sealed when the dies 10 and 11 are closed is provided.

The sleeve 14 is carried between two spaced upright plates, one of which is designated 37, fixed to the frame 21. The position of the upright spaced plates 37 and the housing 14 may be adjusted by operation of a positioning mechanism 38 which includes an axial adjustment screw 39 and left-right adjustment screws 40.

The degater knife 12 is reciprocably mounted within a bore 41 through the sleeve 14 by linear ball bushings 42 which support and guide the degater knife 12. The bottom end 44 of the degater knife 12 is suitably formed to provide a shear surface for severing a sprue from a casting. The degater knife 12 may be driven from a fully retracted position (FIG. 1) spaced from the mold cavity 30 to a fully extended position (FIG. 2) generally between the open back dies 10 at a position where the mold cavity 30 and the injection gate 31 would meet if the back dies 10 were closed. Attached to the top portion of the degater knife 12 is a clevis 45 for connection to the rocker arm 18.

The rocker arm 18 is disposed between the spaced plates 37 and is pivotally mounted by a pin 47 and a bearing 48 carried by the spaced plates 37 so that it will pivot about an axis fixed relative to the supporting frame 21 above the front die 11. The rocker arm 18 has its upward end 54 disposed within the yoke 55 of the clevis 45. A clevis pin 57 extends through a slot 58 in the end 54 to provide a connection between the degater knife 12 and the rocker arm 18.

Springs, one of which is designated 60, are secured to the rocker arm 18, one on either side, and to the plates 37 to continuously bias the rocker arm 18 to urge the degater knife 12 upwardly toward its retracted position.

The rocker arm has a lower end comprised of spaced legs 64 and 65. Disposed between the lower ends of the spaced legs 64 and 65 of the rocker arm 18 is the cam following roller 20 which is carried by a pin 67 and a bearing 68 extending between the legs 64 and 65. The legs 64 and 65 are disposed on either side of the cam plate 15 so as to mount the cam roller 20 within the cam slot 17. The cam plate 15 is disposed parallel to the axis of movement of the reciprocating front die 11 and thus travels forwardly and rearwardly between the spaced plates 37 and the spaced legs 64 and 65.

The cam slot 17 formed in the cam plate 15 has a cam surface 70 defined by a bottom edge having a rearward segment 71 generally sloping upwardly and forwardly, a projecting central segment 72 and a forward level segment 74.

A timing screw 75 is provided for adjusting the cam plate 15 forwardly and rearwardly on the reciprocating front die 11 to properly position the cam slot 17 relative to the cam roller 20 and synchronize the operation of the degater knife 12 with the opening of the dies 10 and 11.

As a result of the springs 60 biasing the rocker arm 18, the cam roller 20 is urged to travel along the cam surface 70. However, the elimination of the springs 60 does not significantly alter operation of the device, since the cam roller 20 is captive within the cam slot 17 because of the opposing top edge surface 77.

For purposes of illustration, lead wheel weights are being casted herein. A mounting member, such as a U-shaped clip 80 is hung on a lip 81 formed on the die surface 25 of the back dies 10. When the casting 82 is formed, the clip 80 will be included as an element thereof. When the casting 82 has solidified, a sprue 84 of excess casting material will also be formed in the injection gate 31 and the injector nozzle 34, which is not intended to form a part of the completed casting 82 and, therefore, must be removed.

Figure 2:
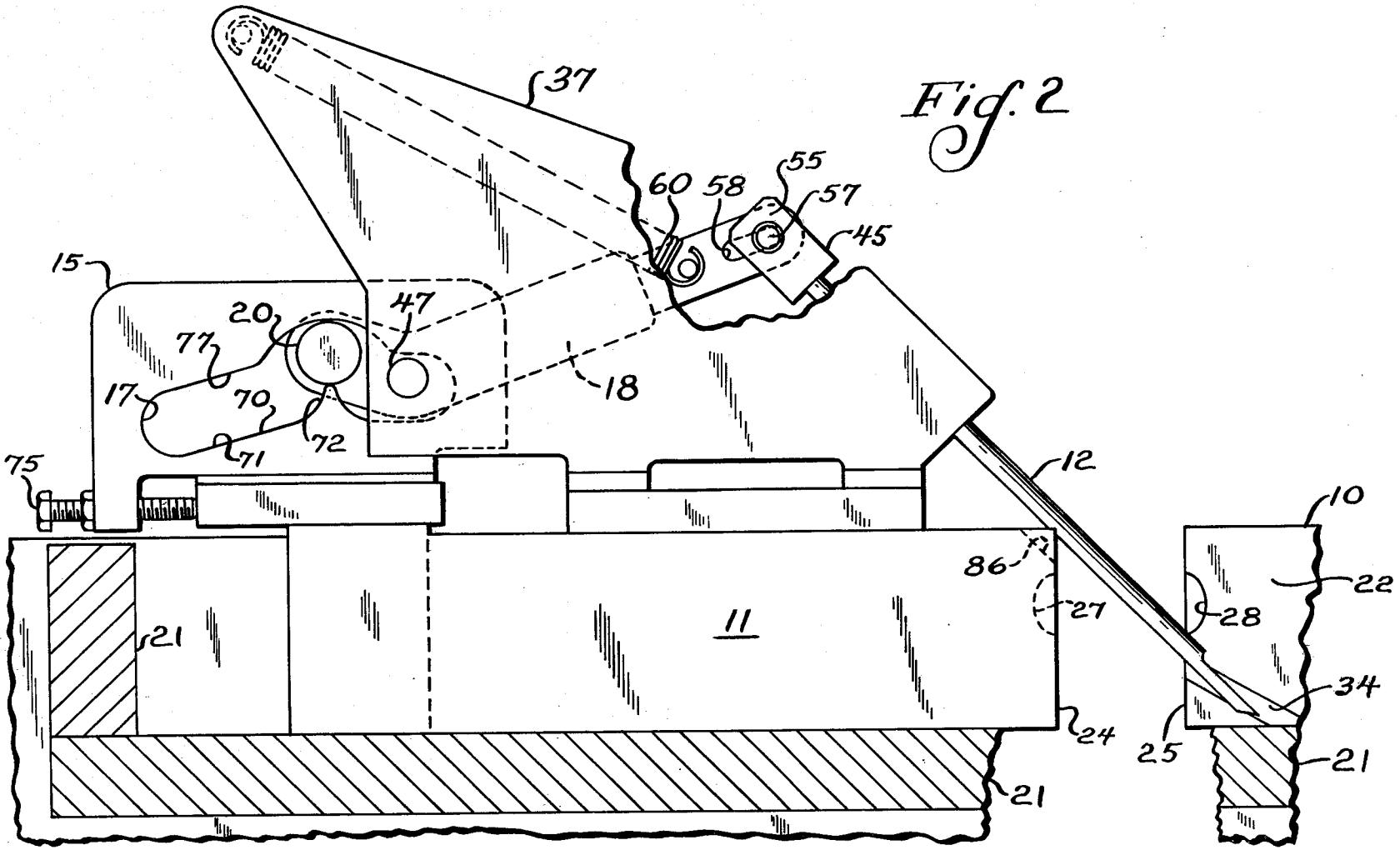
FIG. 2 is a side elevational view similar to FIG. 1, illustrating the dies in a partially opened position and the degater knife in a fully extended position.

In operation, when the dies 10 and 11 are closed, the degater knife 12 is in a retracted position (FIG. 1), and molten lead is injected into the mold cavity 30 to form a wheel weight casting 82 with the clip 80 attached. The casting 82 dwells in the mold cavity 30 until it cools and solidifies. The dies 10 and 11 are opened by simultaneously moving the front die 11 backwardly and the rear dies 10 outwardly. The cam roller 20 travels up the cam surface 70 to swing the lower end of the rocker arm 18 upwardly away from the front die 11 so that the upward end 54 swings toward the rear dies 10 to force the degater knife 12 downward. As seen in FIG. 2, the degater knife 12 travels into an open area between the edge faces 22 created when the rear dies 10 separate. When the cam following roller 20 travels over the projecting segment 72 of the cam slot 17, the degater knife 12 reaches maximum stroke. The degater knife 12 thus cuts off the sprue 84 while the rear dies 10 are still opening, but while the casting 82 is still supported by its clip 80 and the lip 81 of the rear dies 10.

A portion of the front die 11 is cut away to form a slot having a beveled surface 86 which permits the degater knife 12 to move forward to its fully extended position before the front die 11 has been completely retracted.

Figure 3:
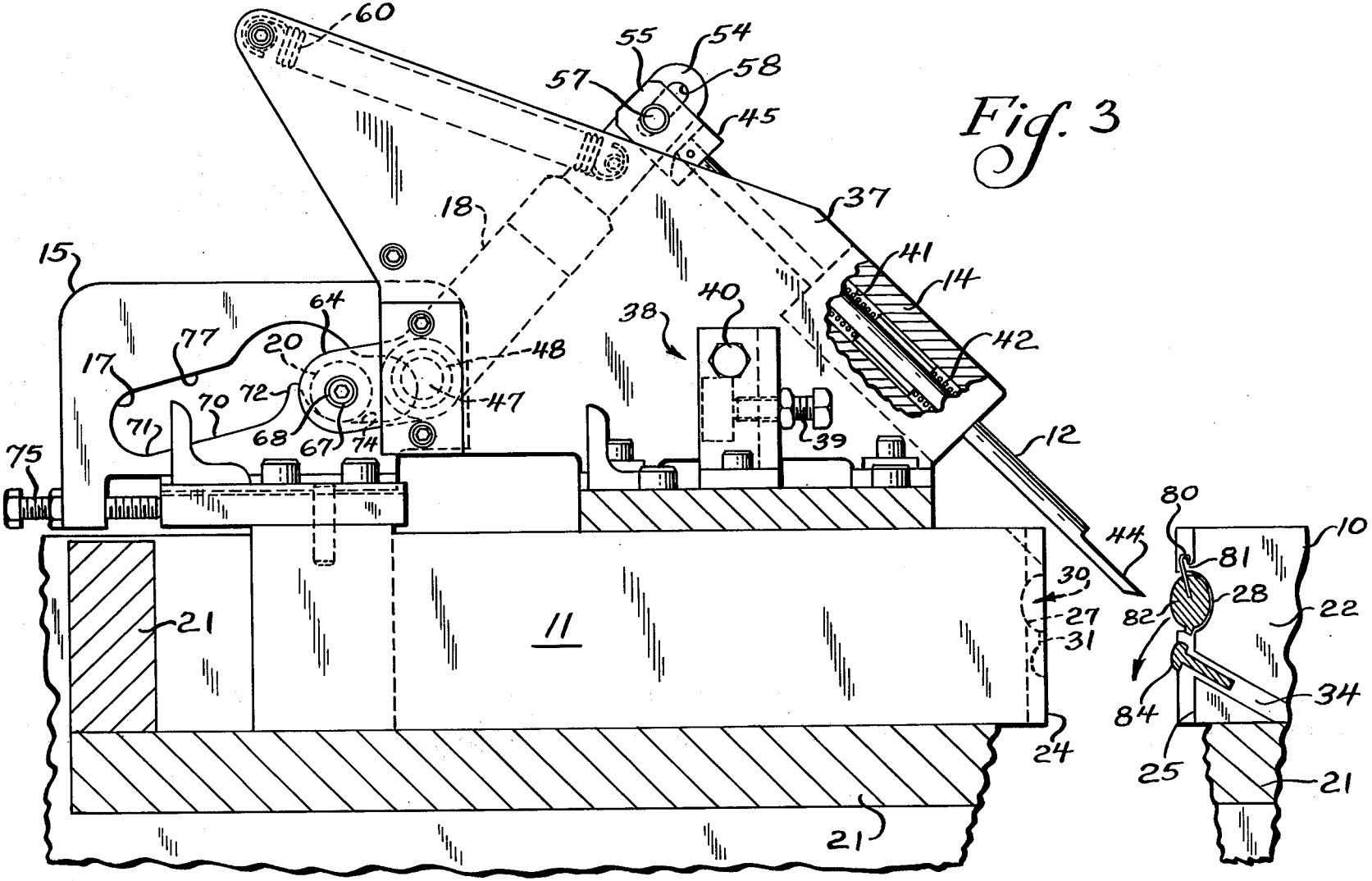
FIG. 3 is a side elevational view similar to FIG. 1 partially in section and illustrating the dies in a full open position and the degater knife in a partially retracted position.

Because of the relatively lower forward segment 74 of the cam surface 70, continued movement of the front die 11 away from the back dies 10 after the degater knife 12 has reached maximum stroke causes the degater knife 12 to partially retract (FIG. 3) to permit the casting 82 to fall free between the fully open rear dies 10. When the casting 82 falls clear, another clip is inserted and the dies 10 and 11 are closed for another machine cycle by moving the front die 11 forwardly, the degater knife movements thereby reversing.

We claim:

1. A die casting apparatus with a sprue removal mechanism including a supporting frame, a first die mounted on the frame having two transversely separable segments, a second die reciprocably mounted on the frame longitudinally movable into engagement with the first die, the dies having mating faces defining a mold cavity therebetween when in closed engagement, and an injection gate through which molding material is delivered to the mold cavity, the sprue removal mechanism comprising:

a rocker arm having oppositely disposed end portions, said rocker arm being pivotally mounted to the supporting frame intermediate said end portions to swing about an axis fixed relative to the supporting frame;

cam means fixed to the second die for movement therewith;

cam following means carried by one of said end portions of said rocker arm for operatively engaging said cam means; and a degater knife mechanically connected to the other of said end portions of said rocker arm, said degater knife being adapted to sever a sprue from a casting whereby movement of the second die away from the first die causes said cam following means to travel along said cam means to pivot said rocker arm about said fixed axis and drive said knife from a retracted position spaced from the mold cavity to an extended position between the open first die segments to sever the sprue from the casting while the casting is supported by the first die segments.

2. A die casting apparatus with a sprue removal mechanism including a supporting frame, a first die mounted on the frame having two transversely separable segments, a second die reciprocably mounted on the frame longitudinally movable into engagement with the first die, the dies having mating faces defining a mold cavity therebetween when in closed engagement, and an injection gate through which molding material is delivered to the mold cavity, the sprue removal mechanism comprising:

a degater knife adapted to sever a sprue from a casting; and a rocker arm having oppositely disposed end portions, said rocker arm being pivotally mounted to the supporting frame intermediate said end portions to swing about an axis fixed relative to the supporting frame, one of said end portions of said rocker arm being mechanically connected to the second die, the other of said end portions of said rocker arm being mechanically connected to said degater knife, whereby movement of the second die away from the first die pivots said rocker arm about said fixed axis to drive said degater knife from a retracted position spaced from the mold cavity to an extended position between the open first die segments to sever the sprue from the casting, while the casting is supported by the first die segments.

3. A die casting apparatus with a sprue removal mechanism having a supporting frame, a first die, a second die movable into engagement with the first die, the dies having mating faces defining a mold cavity therebetween when in closed engagement, and an injection gate through which molding material is delivered to the mold cavity, the sprue removal mechanism comprising:

a degater knife adapted to sever a sprue from a casting;

means for mounting said knife for reciprocable movement between a retracted position spaced from the mold cavity and an extended position between the casting and the sprue; and a rocker arm having one portion mechanically connected to the second die and another portion mechanically connected to said knife, said rocker arm being pivotally mounted to the supporting frame to swing about an axis fixed relative to the supporting frame, whereby movement of the second die away from the first die pivots said rocker arm about said pivot axis to drive said knife from its retracted position toward the first die to its extended position to sever the sprue from the casting while the casting is supported by the first die.

4. The sprue removal mechanism of claim 3 further including cam means fixed to one of the second die and said one portion of said rocker arm and cam following means carried by the other of the second die to said one portion of said rocker arm, said cam following means engaging said cam means to operatively connect said rocker arm to the second die, movement of the second die away from the first die moving said cam means relative to said cam following means to pivot said rocker arm about said fixed axis and drive said knife from its retracted position to its extended position.

5. The sprue removal mechanism of claim 4 wherein said fixed axis is remote from the dies, said rocker arm being pivotally mounted to have said connected portions disposed on opposite sides of said fixed axis so that when said one portion of said rocker arm is moved away from the second die, said other portion of said rocker arm is pivoted about said fixed axis toward the first die to drive said knife connected to said other portion toward its extended position.

6. The sprue removal mechanism of claim 5 wherein said cam means is a plate carried by the second die having a cam surface formed therein and said cam following means is a roller mounted on said one portion of said rocker arm, said cam surface having a segment oblique to the direction in which the second die is movable away from the first die so that as the second die moves away from the first die, the cam roller travels along said oblique segment away from the second die to pivot said rocker arm and move said knife to its extended position.

7. The sprue removal mechanism of claim 6 wherein said cam surface has a second segment oblique to said first oblique segment so that as the second die continues to move away from the first die said cam roller travels along said second oblique segment toward the second die to pivot said rocker arm and retract said knife after it has reached a fully extended position.

8. The sprue removal mechanism of claim 6 wherein said plate has a cam slot, said cam surface forming an edge of said slot, the opposite edge of said slot preventing disengagement of said cam roller and said cam surface.

9. The sprue removal mechanism of claim 4 further including spring means for biasing said knife away from its extended position toward its retracted position and biasing said one portion of said rocker arm downward toward the second die so that said cam following means is urged into engagement with said cam means.

* * * * *